US006834646B2

(12) United States Patent
Alon et al.

(10) Patent No.: US 6,834,646 B2
(45) Date of Patent: Dec. 28, 2004

(54) RESPIRATORY HOOD

(75) Inventors: Uri Alon, Moshav Hadar Am (IL); Yaron Reshef, Pardesiya (IL); Elhanan Schaham, Ramat Gan (IL)

(73) Assignee: Testa Technologies T.T. Ltd., Jerusalem (IL)

( * ) Notice: Subject to any disclaimer, the term of this patent is extended or adjusted under 35 U.S.C. 154(b) by 104 days.

(21) Appl. No.: 10/020,936

(22) Filed: Dec. 19, 2001

(65) Prior Publication Data

US 2003/0111074 A1 Jun. 19, 2003

(51) Int. Cl.[7] ..... A62B 18/00

(52) U.S. Cl. ..... 128/201.22; 128/201.25; 128/205.25; 128/205.27

(58) Field of Search ..... 128/205.27, 205.29, 128/206.17, 201.23, 205.22, 201.25

(56) References Cited

U.S. PATENT DOCUMENTS

| | | | | | |
|---|---|---|---|---|---|
| 3,073,301 | A | | 1/1963 | Hay et al. | |
| 3,762,407 | A | | 10/1973 | Shonerd | |
| 3,976,063 | A | | 8/1976 | Henneman et al. | |
| 4,430,995 | A | * | 2/1984 | Hilton | 128/204.21 |
| 4,502,157 | A | | 3/1985 | Wong | |
| 4,590,951 | A | | 5/1986 | O'Connor | |
| 4,683,880 | A | | 8/1987 | Werjefelt | |
| 4,766,893 | A | * | 8/1988 | Drews | 128/201.29 |
| 4,793,342 | A | * | 12/1988 | Haber et al. | 128/202.27 |
| 4,889,740 | A | | 12/1989 | Price | |
| 5,009,225 | A | * | 4/1991 | Vrabel | 128/201.24 |
| 5,113,854 | A | | 5/1992 | Dosch et al. | |
| 5,115,804 | A | * | 5/1992 | Brookman | 128/201.22 |
| 5,186,165 | A | * | 2/1993 | Swann | 128/201.28 |
| 5,265,592 | A | | 11/1993 | Beaussant | |
| 5,394,870 | A | | 3/1995 | Johansson | |
| 5,413,097 | A | * | 5/1995 | Birenheide et al. | 128/206.17 |
| 5,555,879 | A | * | 9/1996 | Helin et al. | 128/201.24 |
| 5,819,728 | A | | 10/1998 | Ritchie | |
| 6,186,140 | B1 | * | 2/2001 | Hoague | 128/202.22 |
| 6,247,471 | B1 | | 6/2001 | Bower et al. | |
| 6,321,764 | B1 | | 11/2001 | Gauger et al. | |

FOREIGN PATENT DOCUMENTS

| | | |
|---|---|---|
| GB | 2 226 490 A | 7/1990 |
| GB | 2 247 175 A | 2/1992 |

* cited by examiner

*Primary Examiner*—Glenn K. Dawson
*Assistant Examiner*—Darwin P Erezo
(74) *Attorney, Agent, or Firm*—Browdy and Neimark, P.L.L.C.

(57) ABSTRACT

A positive-pressure respirator hood assembly comprising, a gas-impermeable hood made of a flexible material, formed with at least a transparent visor portion; a gas treatment unit, comprising a filter and a power-operated blower to force air through the filter and generate a positive pressure within the hood; a one-way purge valve for facilitating the exhaust of exhaled gases and moisture from the hood; and a sealing portion for sealingly securing the hood over a body portion of the user; the respirator hood assembly is designed to be compactly received in a container and to be deployed into an operative state automatically, whereby a user is provided protection from toxic gases and particulate material.

28 Claims, 12 Drawing Sheets

RESPIRATORY HOOD

FIELD OF THE INVENTION

This invention relates to emergency safety equipment, particularly respirator hoods that provide filtered air to persons in toxic environments.

BACKGROUND OF THE INVENTION

There is increasing interest both from governmental agencies and the general public in protecting individuals from the harmful effects of toxic materials in the event of accidental incidents such as chemical spills, escape of toxic and noxious gases, smoke filled areas, dust and fumes, and in the event of chemical, biological, or other terror events.

In addition, there is a strong desire among certain people to protect their pets and work animals (seeing-eye dogs, livestock, etc.) from the same harmful effects.

Immediate protection of the respiratory tracts, eyes, and skin is required in such incidents and many of these incidents occur with little or no warning. This requires that any equipment used to protect the individual or animal (hereinafter in the specification and claims referred to as "user") be readily available, i.e. carried with the user or stored nearby, and readily deployable into an operative state.

Protective industrial masks, hoods, and powered air respirators are known, but they require skills and training in order to provide adequate protection. They are also bulky and not designed to be conveniently carried and rapidly deployed.

Often the user exposed to the toxic environment is untrained in safety procedures, such as how to don and activate a powered air respirator hood.

Most of the existing respiratory protective means are by necessity made in several sizes and do not fit both adults and children in one size.

In the event of a sudden or unexpected situation resulting in a toxic or noxious environment, it is clearly an advantage to have a device to supply filtered or purified air and also to provide nominal protection to the otherwise exposed skin of the head and neck from gases, liquids/droplets, particles, fine sprays and aerosols. Advantageously, the device should be readily available (easily carried and/or stored) and suitable for a wide size-range of users (adults, children, the elderly, the infirm, handicapped and sick people, people with beards, eyeglasses, long hair, etc., and animals) without a need to conform to facial features or body shapes. Furthermore, it is preferable that the activation and functioning is automatic, the donning is self-explanatory and comfortable, and the device is suitable for extended operation as well as short term use. It is also advantageous that the device has a long shelf life.

SUMMARY OF THE INVENTION

Accordingly, it is the objective of this invention to provide a device that is protects a user from toxic environments for quick escape or for an extended period of time, typically for up to several hours, that is collapsible, easily carried or stored, compact, lightweight, comfortable, easy to use, one-size-fits-all, whose donning is self-explanatory, whose activation is automatic, and requires no training for use.

The present invention is concerned with a positive-pressure respirator hood assembly comprising, a gas-impermeable hood made of a flexible material, and comprising at least a portion which is a transparent visor, a gas treatment unit comprising a filter for filtering particles, fine spray, aerosols, and toxic and noxious gases etc. hereinafter "hazardous materials"), and a power-operated blower to generate a positive pressure wit the hood; a one-way purge valve for facilitating the exhaust of exhalation gases and moisture from the hood; and a sealing portion for sealingly securing the hood over a body portion of the user. The hood assembly is designed to allow near immediate donning to a wide range of users, requiring no training to don and operate the hood assembly, whereby a user is protected from inhalation of and facial contact with the hazardous materials.

The respirator hood is received within a container that is easily carried whereby upon opening the container and removing the respirator hood, the respirator hood is fully operational as the gas treatment unit is automatically activated. The respirator hood is foldable to allow it to fit within a small size container.

The hood, including the sealing portion, is designed such that one size provides protection from a toxic environment to users whether male or female, regardless of facial or head features such as beard, hair length/thickness, eyeglasses, etc, and regardless of size (from toddlers to large adults). The design of the hood also allows it to be used to protect animals such as pets, livestock, etc.

According to one embodiment of the invention, the sealing portion is an elastic neck seal and according to another embodiment, the sealing portion is a torso-engaging and sealing wrap.

The respirator hood may be carried and protected by a rigid container (case), in a flexible container or in a flexible container received within a case. Typically, the respirator hood is received within a sealed package for imparting it extended shelf life.

The respirator hood may be provided in some principal configurations, e.g. one for individuals from toddlers to adults, another for infants up to about the age of three years, and yet another for animals.

According to some particular designs, the operation of the blower can be stopped and the respiration hood may then be preserved for future use.

BRIEF DESCRIPTION OF THE DRAWINGS

In order to understand the invention and to see how it may be carried out in practice, a preferred embodiment will now be described by way of non-limiting example only, with reference to the accompanying drawings, in which.

DETAILED DESCRIPTION OF THE INVENTION

The present invention is a respirator hood assembly that is portable, compact, easy to store, easy to carry, easy to don, easy and comfortable to use, is designed in a one-size-fits-all manner for users of a wide range of sizes, requires no training for use, and is activated and operates automatically.

Herein, the terms gas and gases are meant to denote the mixture of air and toxic and/or noxious gas or biological warfare agents, which may include particles, fine spray, aerosols, or droplets, collectively referred to as hazardous materials.

Figure 1:
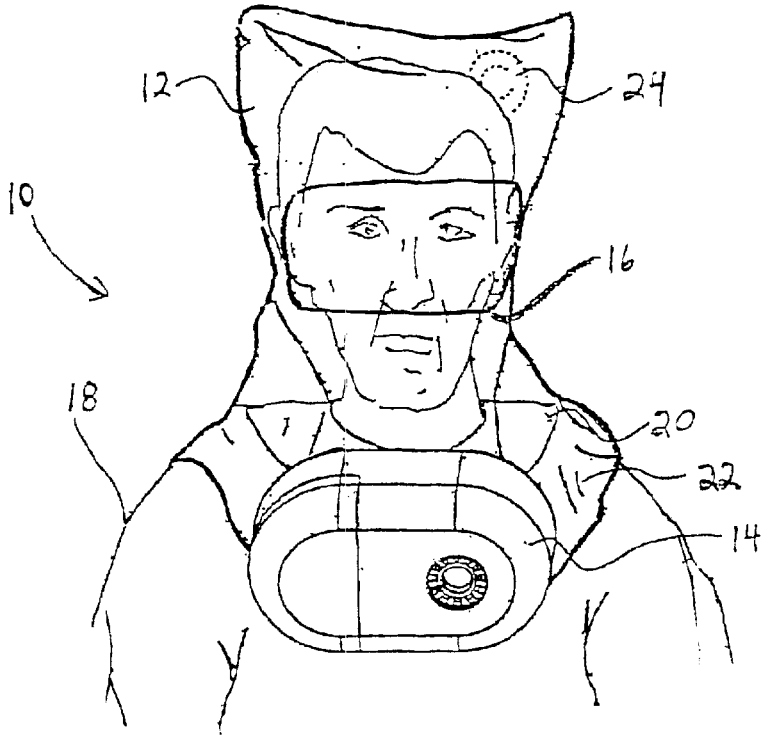
FIG. 1 is a front view of a respirator hood according to one embodiment of the invention, being worn by a user.

Referring fist to FIG. 1, a respirator hood, generally designated 10, is shown which comprises a hood 12, made of a flexible, gas and liquid-impermeable material and a gas treatment unit 14 attached to the hood 12. The hood 12 includes a visor 16, also made of a flexible, gas-impermeable material, positioned adjacent to the eyes of a user 18.

Still referring to FIG. 1, fastened to the hood 12 is a sealing portion in the form of a collar or neck seal 20 made of an elastic material such as silicone, polyurethane, latex rubber, etc., allowing easy donning and requiring no latches, straps, ties, or the like. The neck seal 20 is sized to be, in the non-stretched condition, slightly smaller than that of a small toddler and whose material is such that it is easily stretched to a size conveniently larger than the head of a large adult user 18 regardless of long or thick hair, beards, etc. Further, the neck seal 20 is dimensionzed to be wide enough for wearing comfort. With this design, the respirator hood 10 is easily and conveniently donned within seconds by a wide range of individuals without need for training or operating instructions.

FIG. 1 further shows a cape or shroud 22 extending downward in a skirt-like manner fitting around tee neck toward the shoulders of the user 18 to protect the neck. A one-way purge valve 24 is integrated into the hood 12 to facilitate the exhaust of perspiration and exhalation gases such as carbon dioxide and moisture from the hood 12 while not allowing the entrance therethrough of outside gases. The one-way purge valve may be any suitable valve, outlet, or flow device, permitting the flow of gases, vapors or moisture in one direction only.

Figure 2:
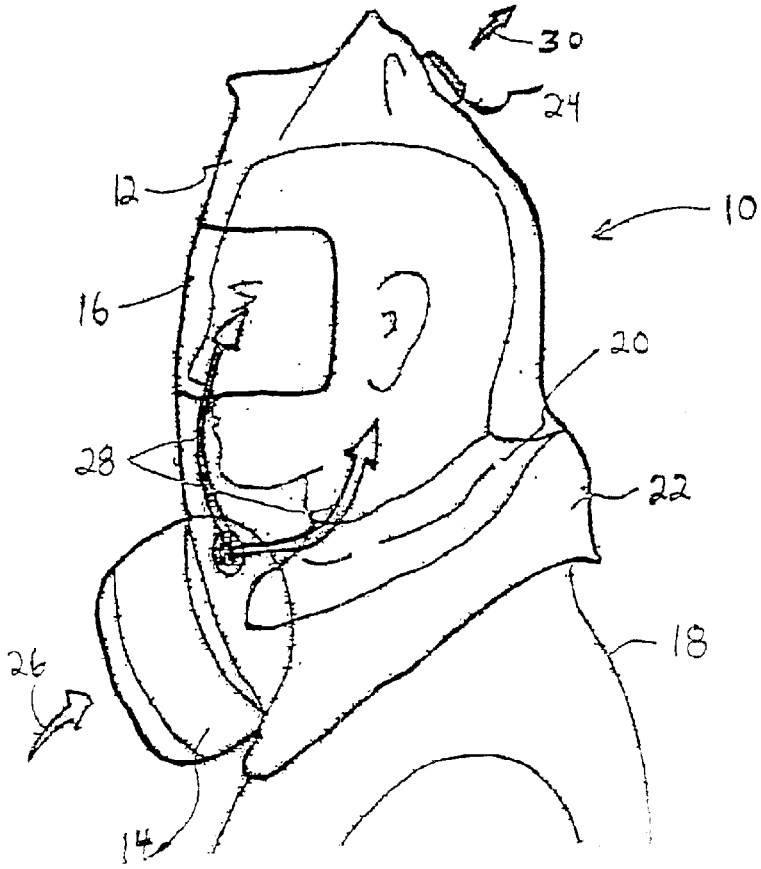
FIG. 2 is a side view of the respirator hood of FIG. 1.

In FIG. 2 arrow 26 shows where ambient gases enter the gas treatment unit 14, arrow 28 shows where filtered air then enters the hood 12, and arrow 30 shows where exhalation (exhaled air) and moisture exit from the hood 12 via the purge valve 24. Seen again are side views of the visor 16 the neck seal 20, and the shroud 22.

Figure 3:
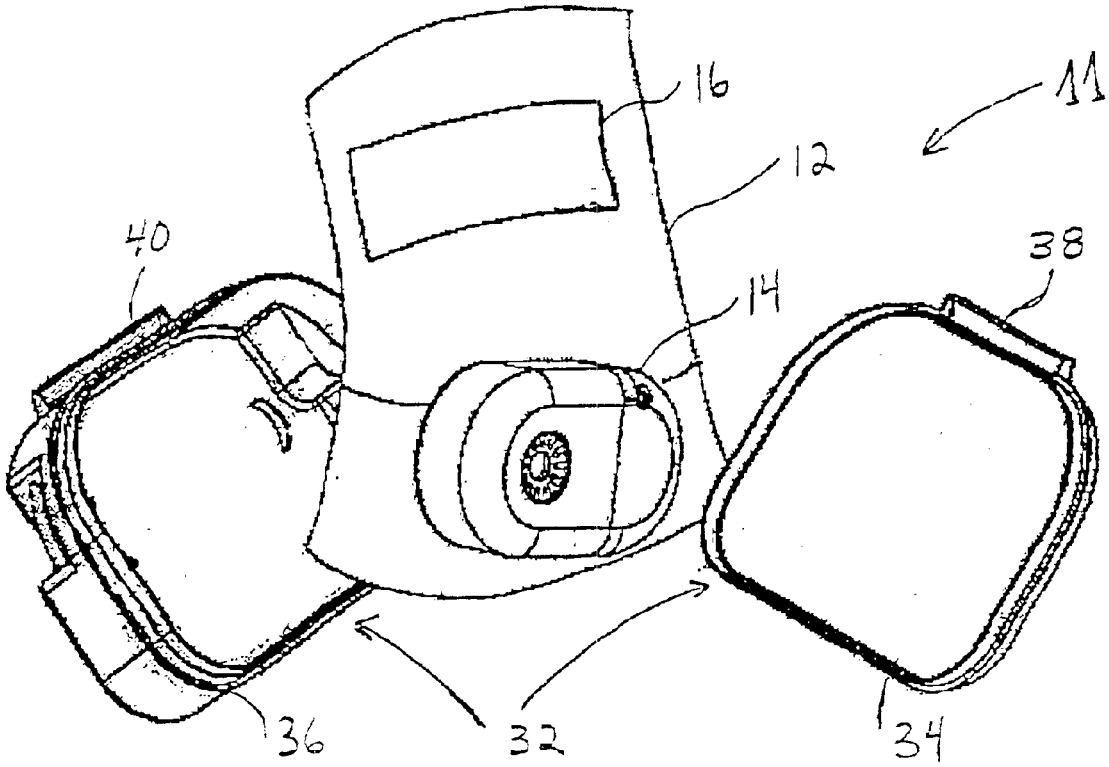
FIG. 3 is a general exploded view illustrating the respirator hood removed from its container.

FIG. 3 shows a respirator hood assembly 11 comprising the respirator hood 10 and its container, which is in the form of a rigid case, generally designated 32, after the container 32 has been opened and the respirator hood 10 has emerged. At this point the respirator hood 10 is completely ready for donning and use. Container 32 comprises a front cover 34 and a rear cover 36.

The covers 34 and 36 are not part of the respirator hood 10 that is worn by the user 22, however they are important in that they form the container 32 which forms a protective casing around the respirator hood 10 in order ensure/prolong the shelf life. Optionally, a gas-impermeable seal is formed which prevents the ingress of humidity since filters of the type used in respiratory protective devices are sensitive to humidity. The container 32 can be carried using either of its front handle 38 and a rear handle 40, which are part of the container 32. The handles 38 and 40 are also used to open the container 32, which automatically activates the gas treatment unit 14, as described below. Additionally, the container 32 plays a significant role in activation of the gas treatment unit 14, as will become apparent hereinafter.

Figure 4A:
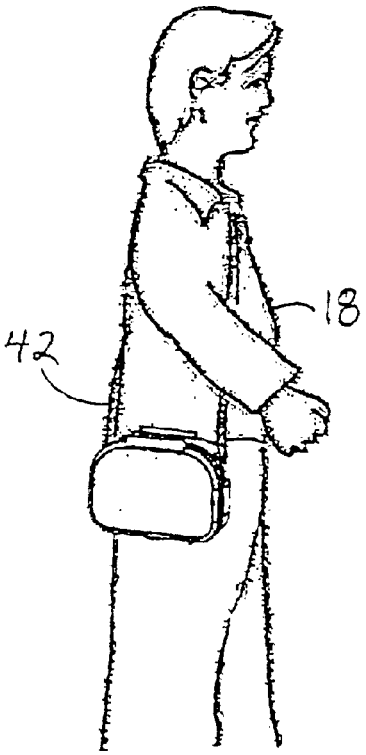
FIG. 4A shows a user carrying the respirator hood as a carry along device.
Figure 4B:
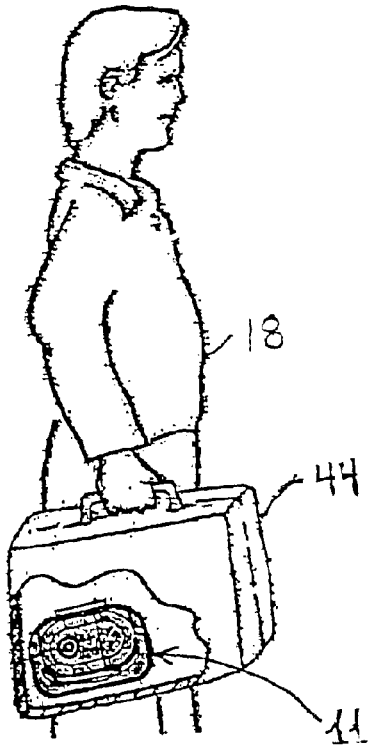
FIG. 4B shows a user carrying the respirator hood in a briefcase.

FIGS. 4A and 4B illustrate how the lightweight and compact respirator hood assembly 11 is easily carried by the user 18 as a carry along (FIG. 4A) or may fit within a briefcase 44 (FIG. 4B). If carried as a carry along, as shown in FIG. 4A, the assembly 11 can include rings (not shown), or the like, for attaching an auxiliary carrying strap 42. Desirably, the respirator hood assembly 11 fits into a portion of a typical small briefcase 44. Analogously, the respirator hood assembly 11 can be carried in a purse or backpack (not shown).

The convenient carrying and compact storage features of the respirator hood assembly 11 are important in that they provide immediate availability of the respirator hood 10 to the user 18. These features, along with the automatic activation of the gas treatment unit 14 (discussed below) and simple donning, allow he respirator hood 10 to be in fill use within seconds. Rapid deployment can be critical to the health, or even survival, of the user 18.

Figure 5:
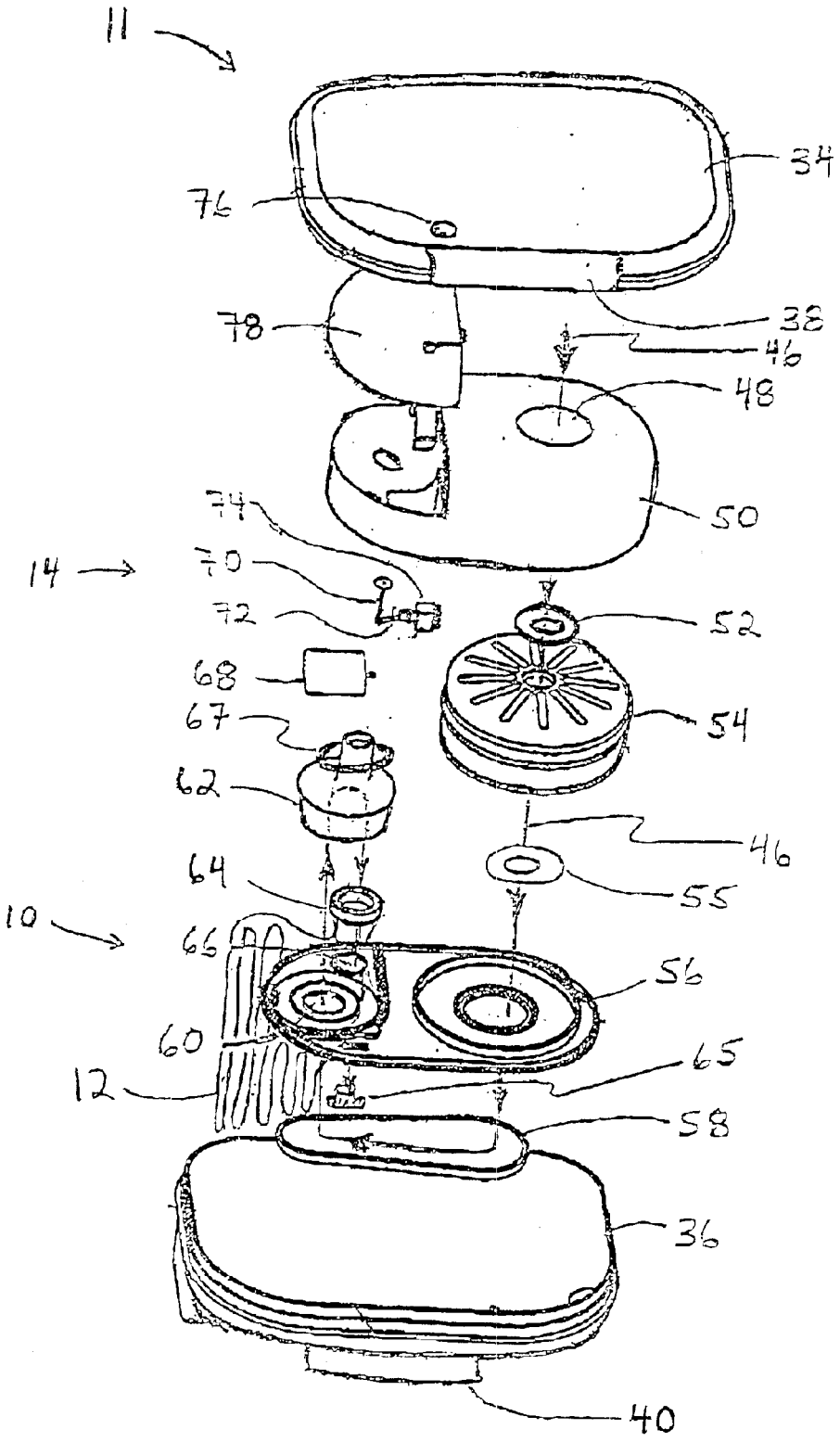
FIG. 5 is a detailed isometric exploded view of the respiratory hood assembly, also showing the gas flow path through the gas treatment unit.

In FIG. 5 an arrow 46 indicates the gas flow path. Gases enter the gas treatment unit 14 firstly through an opening 48 in a housing 50 that accommodates the gas treatment unit 14. The opening 48 is exposed to the ambient as soon as the front cover 34 is detached or removed. A washer 52 provides a seal between the housing 50 and a filter 54 that filters the incoming gases. The filter 54 is any suitable filter as known in the art for filtering of hazardous materials such as particles, toxic/noxious gases, fine sprays and aerosols. The filter 54 is sealed to a base 56 by a washer 55. The base 56 is fitted on a manifold 58. The manifold 58 distributes the gases, now filtered, back through an opening 60 of the base 56. The filtered gases then enter and exit a battery powered blower 62 through a fitting 64 and an opening 66. The blower 62 is sealed to the housing 50 by washer 67. Through the opening 66, the filtered gases enter the hood 12. The hood 12 is fastened to the gas treatment unit 14 between the fitting 64 and a fitting 65. The washers 52, 55 and 67 are all replaceable by a suitable glue or other sealing compound such as silicone or epoxy.

Also seen in FIG. 5 is a battery 68 that powers the blower 62. The power is activated automatically when the covers 34 and 36 of the container 32 are opened, typically by handles 38 and 40. An activating mechanism utilizing a latch 70, a toggle 72, and a switch 74 is explained below. The latch 70 sits in an indentation 76 (see also FIG. 6). Fitting into the housing 50 is a blower cover 78, which can be made in different configurations to add flexibility to the design of the components in the gas treatment unit 14.

Blower 62 produces a positive pressure within the hood 12 which improves thee protection to the user 18 by preventing entry of gases via the neck seal 20 in the event the neck seal 20 is loose or if openings occur due to movement of the user 18. The positive pressure produced by the blower 62 also prevents the entry of gases into the hood 12 as it is donned, prevents build-up of exhalation gases such as carbon dioxide and moisture (including the exhaust of perspiration, which improves the comfort of the user 18).

Figure 6:
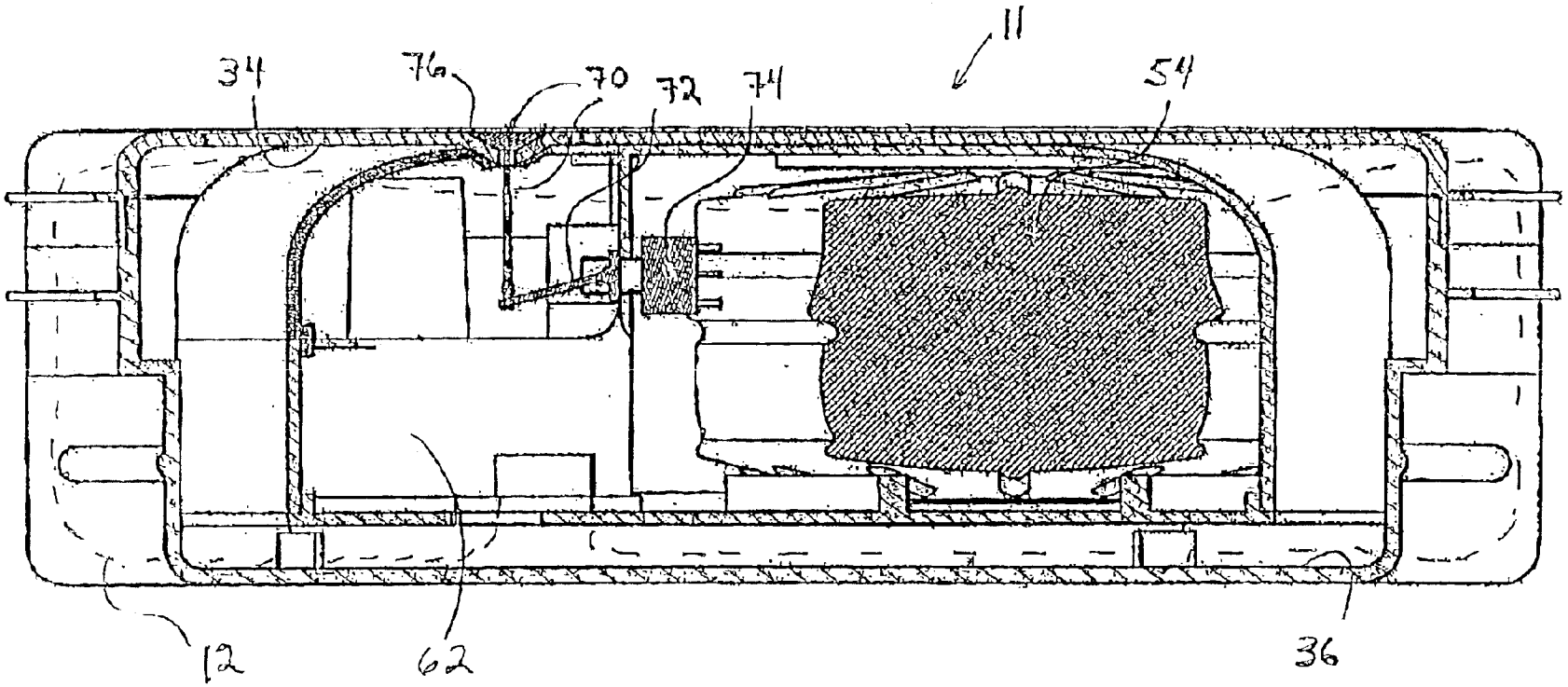
FIG. 6 is a top section of the respiratory hood assembly, illustrating an activation mechanism.

FIG. 6 is a top section of the respirator hood assembly 11 showing the parts that activate the blower 62. The latch 70 the top of which fits in the indentation 76, is actuated when the front cover 34 is opened. Separating the cover 34 from the respirator hood 10 causes the latch 70 to rupture and thus in this embodiment the operation of the respirator hood 10 is irreversible once the respirator hood 10 is operated. As the front cover 34 is detached or removed, latch 70 is pulled outwardly and thereby pulls on toggle 72 which activates the switch 74, thereby facilitating power to the blower 62, which is powered by the battery 68.

Figure 7:
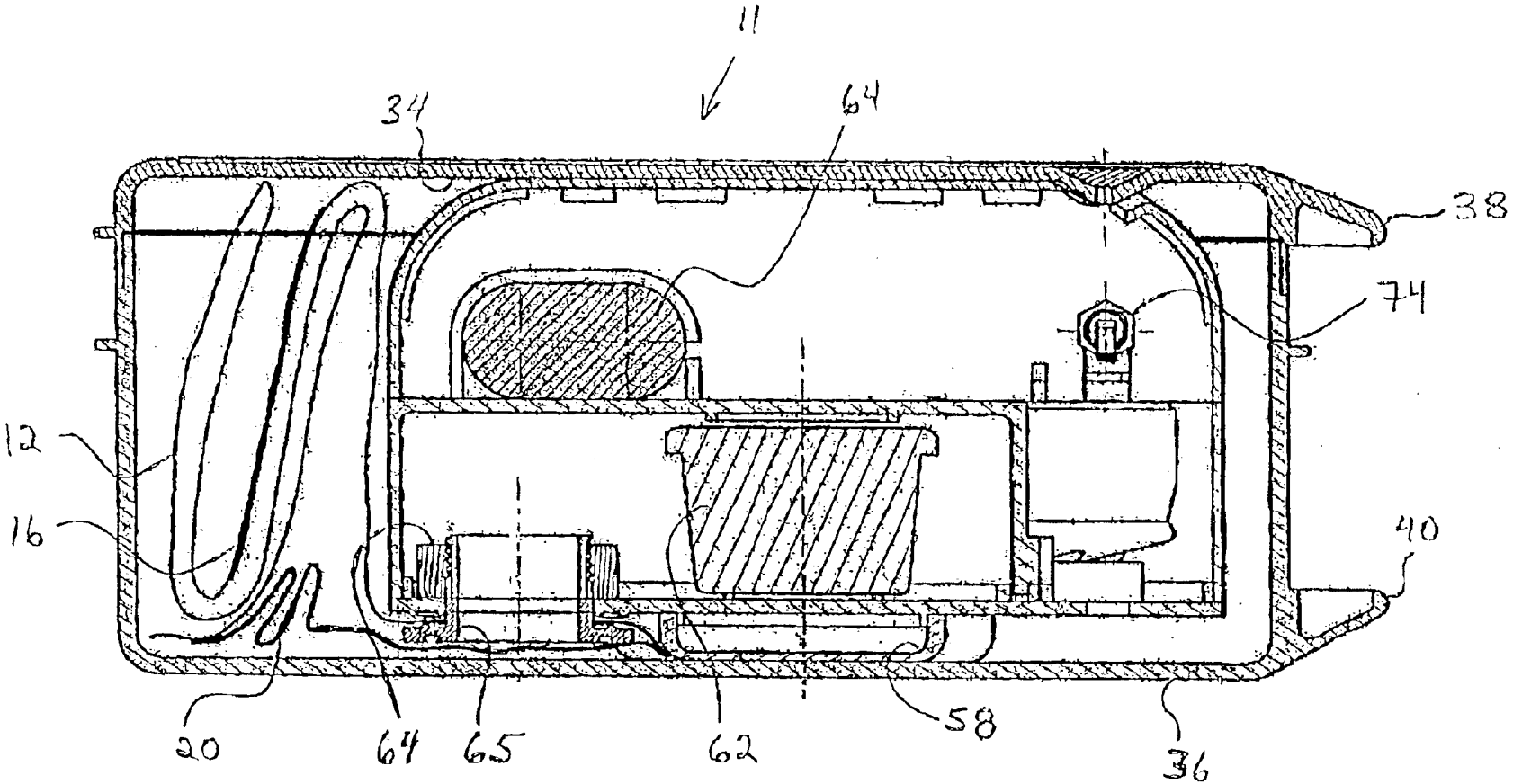
FIG. 7 is a side section of the respiratory hood assembly showing the hood to folded next to the gas treatment unit.

FIG. 7 shows a side section of the respirator hood assembly 11, showing the hood 12 folded between the covers 34 and 36. The compactness of the collapsible hood 12 is illustrated, as well as the fastening of the hood 12 to die gas treatment unit 14 by the fittings 64 and 65.

To use the respirator hood 10, the covers 34 and 36, of container 32, are separated detached and removed. The covers 34 and 36 are no longer needed. As is described above, this activates the blower 62 making the gas treatment unit 14 and respirator hood 10 fully operational. The neck seal 20 is then stretched over the head of the user 18. There are no other actions necessary. Even if the respirator hood 10 is donned backward or to the side, i.e. with the visor 16 not in front of the eyes, the user 18 is still protected. Furthermore, the hood 12, or a large enough portion of it, may be made of a transparent or translucent material affording the user 18 reasonable visibility. Alternatively, the hood 12 can be easily adjusted to a more appropriate. The positive pressure within the hood 12, produced by the blower 62, prevents ingress of the unwanted gases during any adjustment of the hood 12. Thus, the respirator hood 10 is easily operated and used without the need for operating instructions even in time of stress.

It is appreciated that an untrained person of an age of from about three years to a complete, and large sized, adult can have ready access to, and can use a device according to the invention for head and neck protection and for the supply of pressurized purified air in the event of sudden exposure to toxic or noxious gases including particles, fine spray or aerosols.

Figure 8:
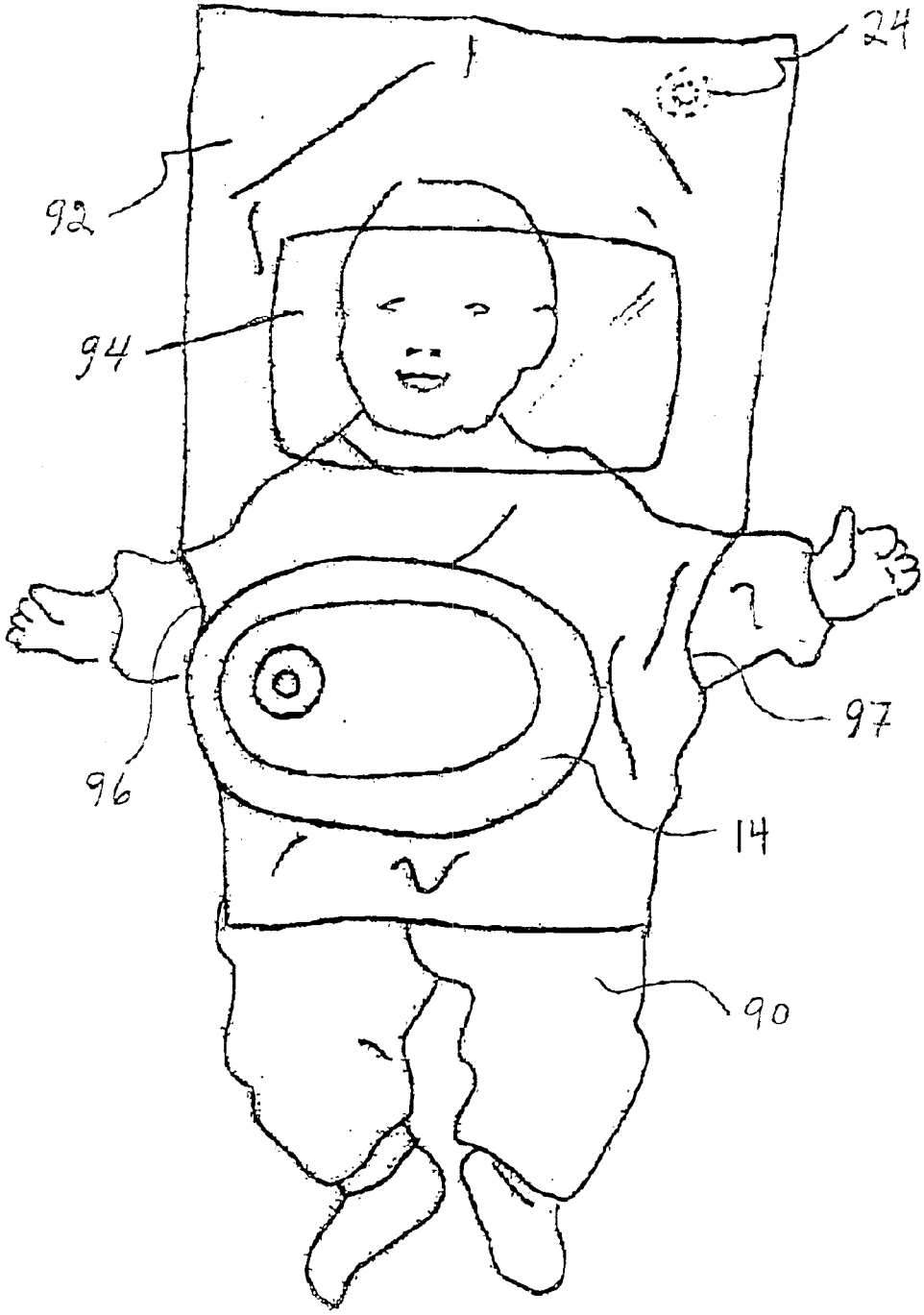
FIG. 8 is a front view of an alternate embodiment of the respirator hood used by an infant.

FIG. 8 illustrates an alternate embodiment where an infant 90 uses the invention. It is dangerous to fit a neck seal around the neck of an infant 90 and so here a hood 92 which includes a visor 94 is designed to fit over the head and upper body of the infant 90. The arms of the infant 90 may be completely inside the hood 92 (this option not shown) or may sealingly protrude tom the sides 96 and 97 which are formed when the hood 92 is closed around the torso of the infant 90.

Figure 9:
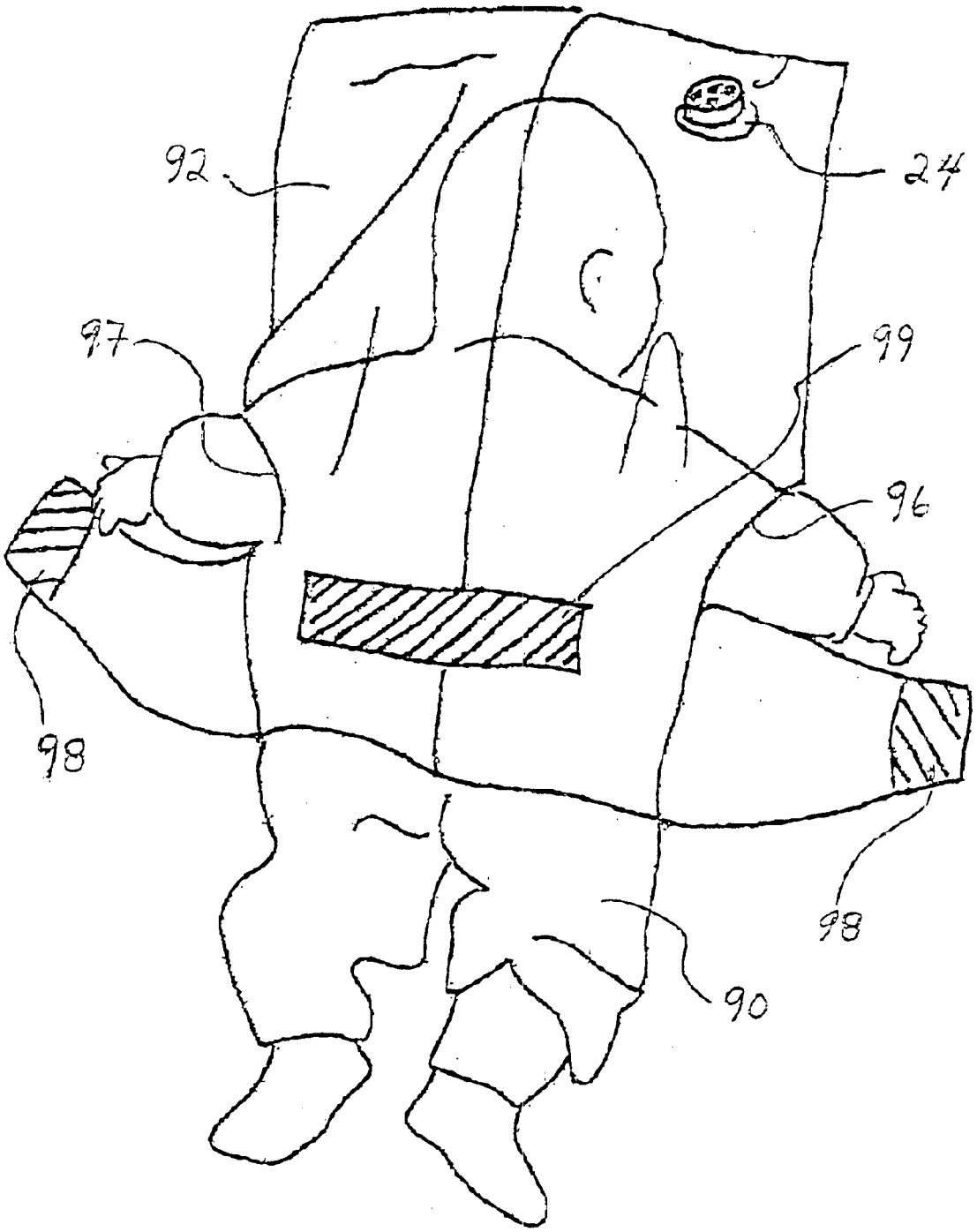
FIG. 9 is a rear view of the alternate embodiment of FIG. 9 illustrating a sealing and closure means.

FIG. 9 illustrates one option of how the alternate embodiment shown in FIG. 9 may be closed around the torso of the infant 90. Any suitable closure means can be used, such as an elastic seal (analogous to neck seal 22) suitable for an infant's torso, however, typically a hook and loop type fastener, commonly known as VELCRO™, is the most convenient. A portion containing hooks 98 and a portion containing loops 99 is shown. The hooks 98 and loops 99 potions can be reversed. This arrangement is also suitable for people suffering from neck injuries, etc.

Figure 10:
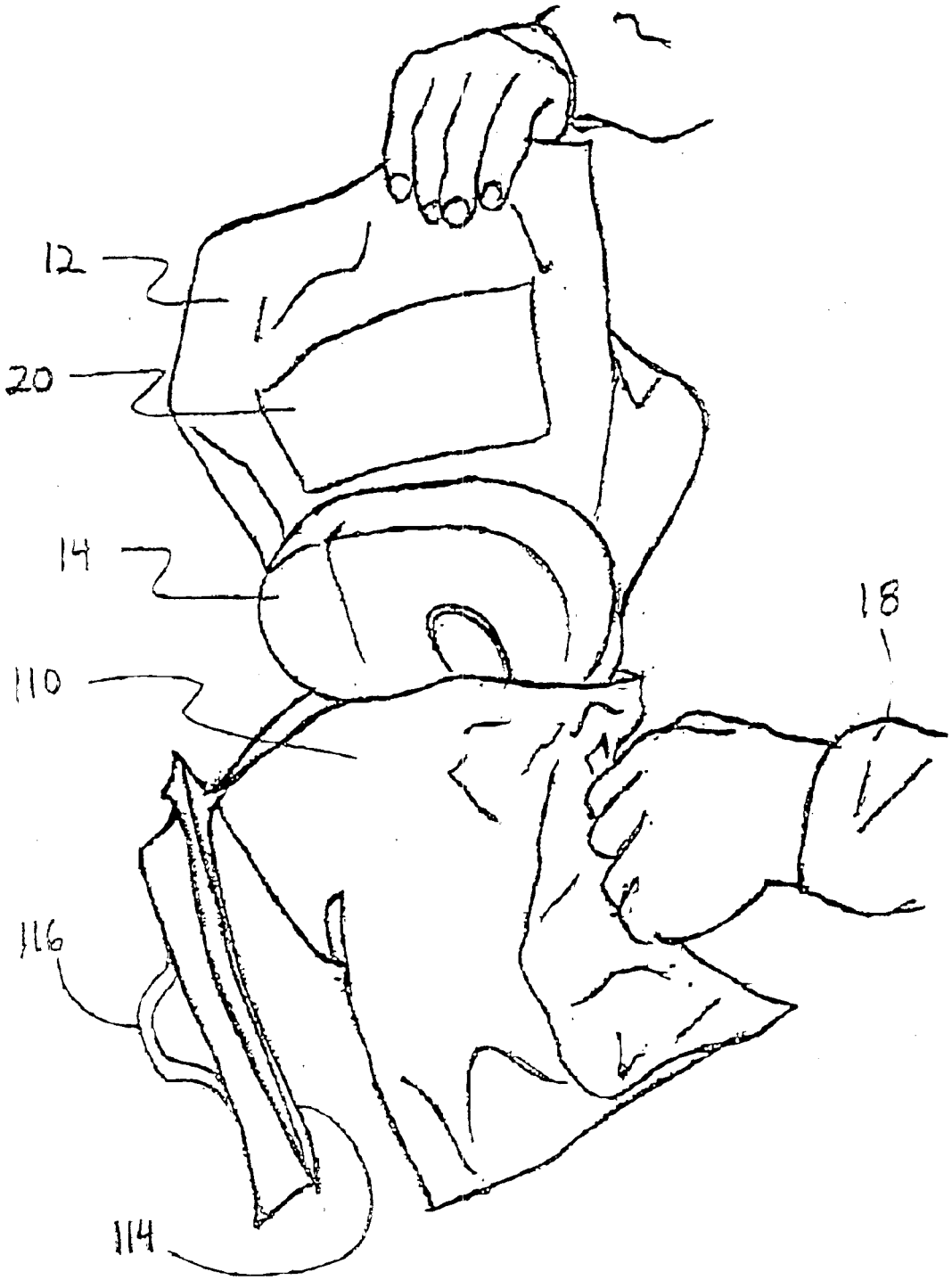
FIG. 10 is an alternate embodiment showing the respirator hood being removed from a flexible container.

FIG. 10 shows a different embodiment in which the respirator is contained in a flexible container such as a foil or laminated bag 110. The bag 110 is made of a gas-impermeable material to protect the respirator hood 10 (especially the filter 62 from humidity, to ensure long shelf life) and is preferably made of a material that provides mechanical protection as well. Automatic activation in this embodiment can be achieved by various means including, for example, by activating a switch such as the switch 74 (FIG. 6) (or a switch 136 shown in FIGS. 12 and 13) which can be articulated with an opening edge 114 of the bag 110, or a tear-ribbon, etc. The bag 110 preferably includes a handle 116 for easy carrying.

It should be understood that several variations on this embodiment are possible, including, but not limited to, one where the respirator hood 10 is activated by stretching the neck seal 22 before donning.

Figure 11:
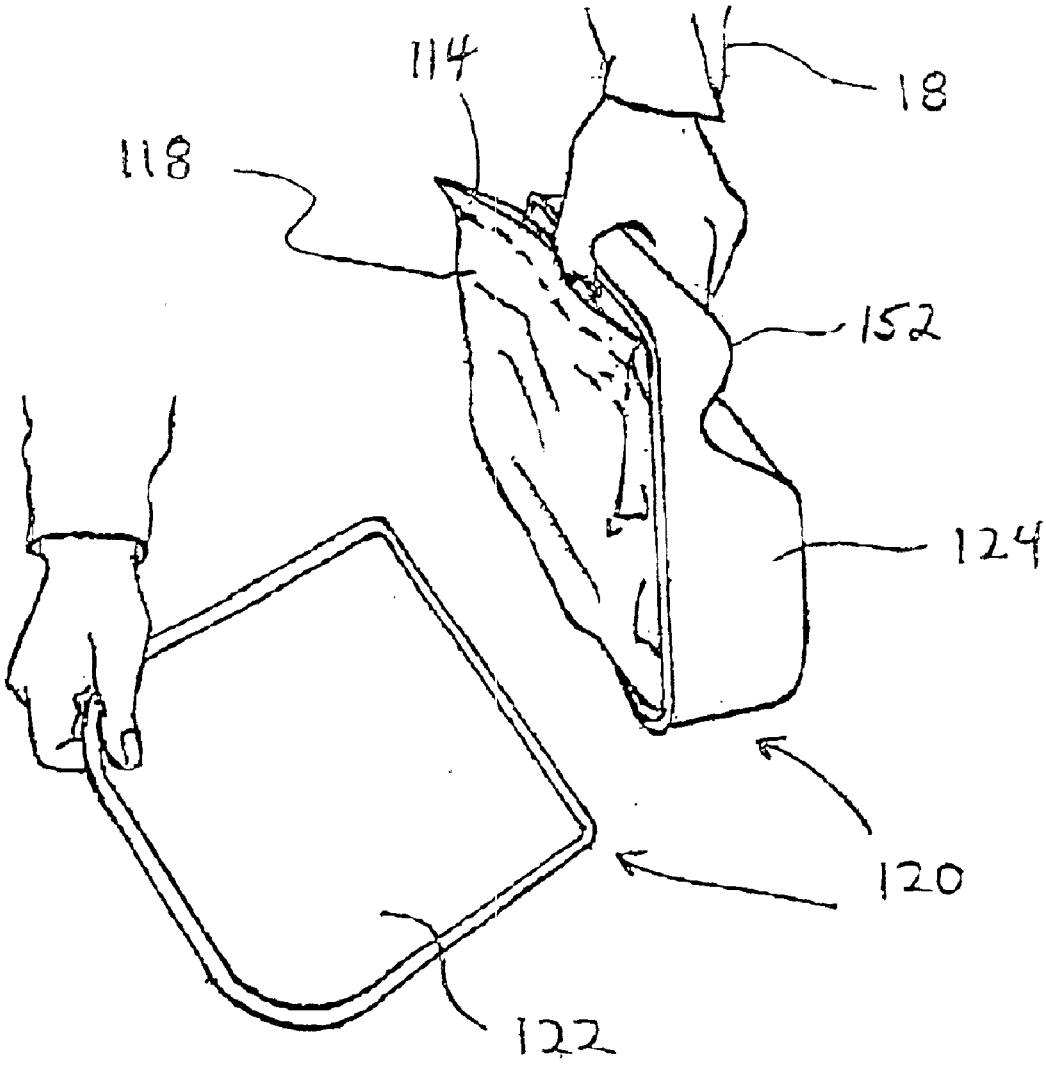
FIG. 11 is an alternate embodiment of the respirator hood showing a packaging comprising a flexible container inside an outer case.

FIG. 11 illustrates a packaging arrangement in which the respirator hood 10 is contained in a flexible container such as a foil, laminated or plastic bag 118 which is further contained within an outer rigid container, generally designated 120, which provides mechanical protection for the respirator hood 10. The outer container 120 could be a rigid case, a tough sack or other suitable container. In this embodiment the bag 118 need not provide mechanical protection, but is still preferably made of a gas-impermeable material. The top cover 122 and bottom cover 124 may be held together by any suitable means such as mechanically, by pressure sensitive adhesive, etc.

Figure 12:
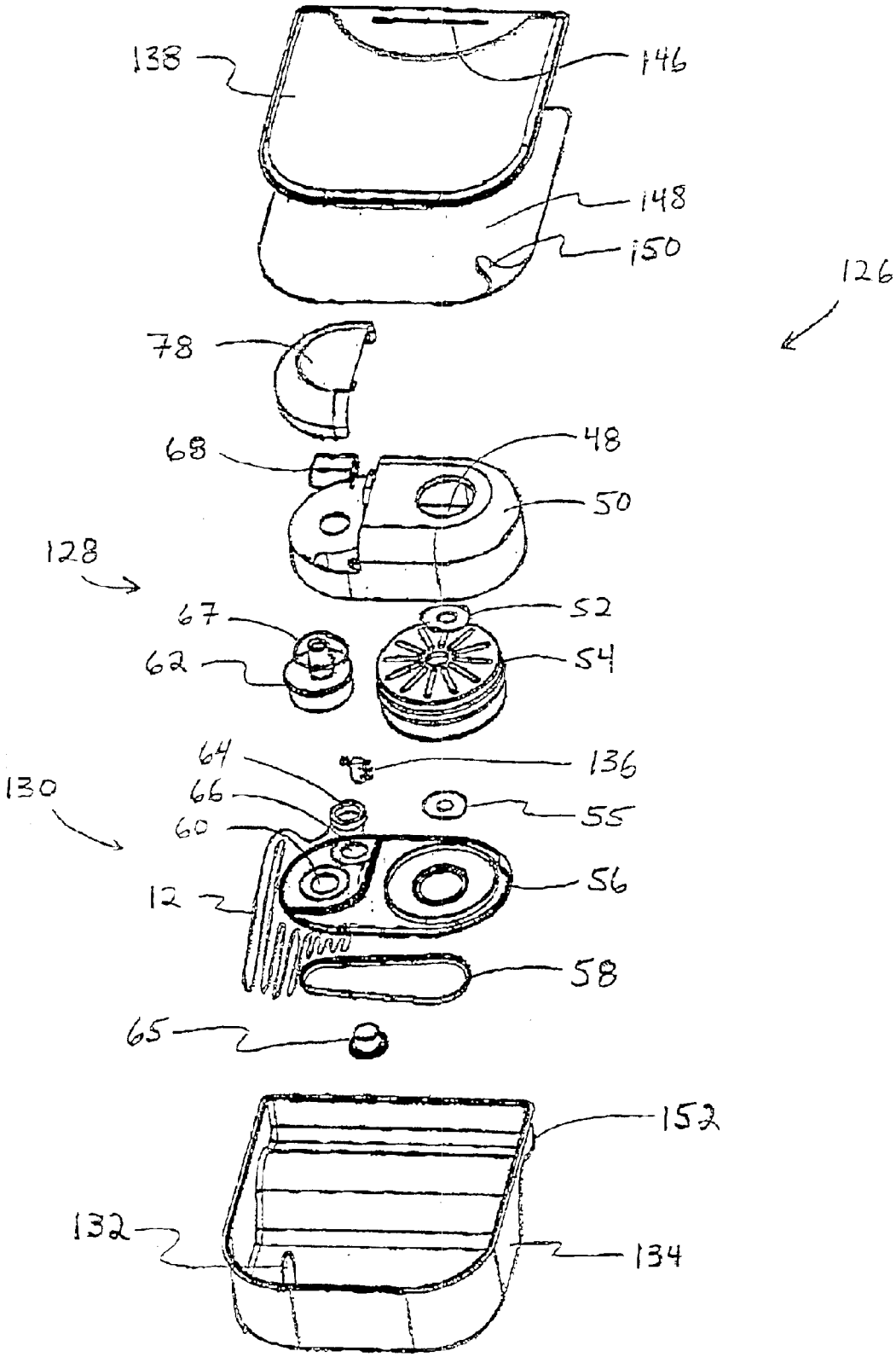
FIG. 12 is an exploded view of an alternate embodiment with re-insertable activation mechanism.

FIG. 12 shows an exploded view of an alternate respirator hood assembly, generally designated 126, emphasizing the internal components of an alternate gas treatment unit, generally designated 128. In this embodiment the activation of a respirator hood, generally designated 130, is reversible, i.e. it is possible to stop the operation of the gas treatment unit 128 and preserve it for future use. This is useful if, for example, the respirator hood 130 was accidentally activated or the user 18 escapes from, but needs to return to a toxic environment, etc.

Figure 13:
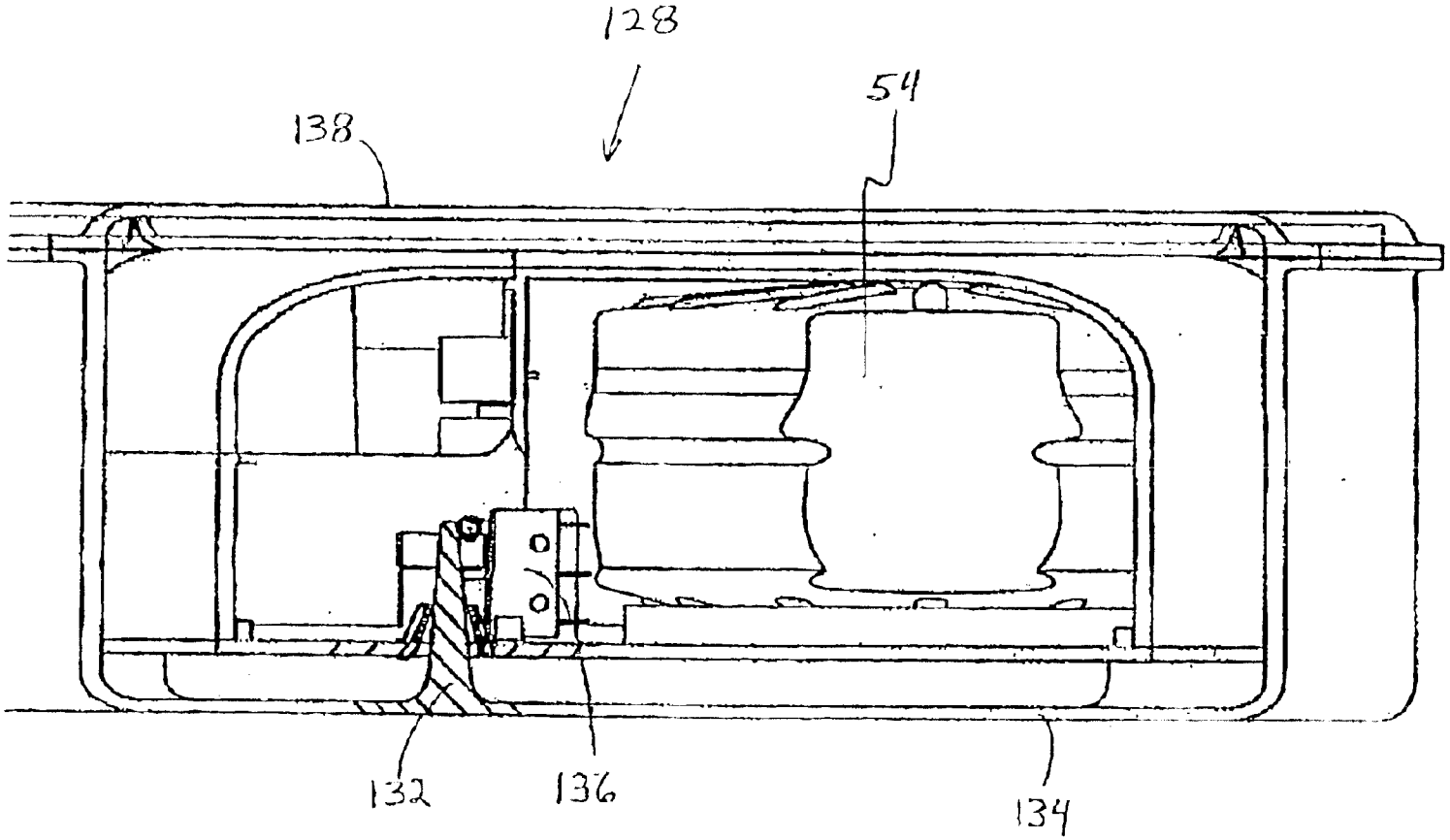
FIG. 13 is a top section of a gas treatment unit of an alternate embodiment highlighting the re-insertable activating mechanism.

An activation pin 132, typically integral to a bottom cover 134, penetrates into the gas treatment unit 128 compressing a switch 136 when the assembly 126 is in the packaged condition (best seen in FIG. 13). Detaching or removal of the respirator hood 130, from the bottom cover 134 detaches the pin 132 from the switch. 136 thereby actuating the switch 136. The pin 132 can be re-inserted to re-compress the switch 136 and shut down the blower 54 of the gas treatment unit 128 to de-activate the respirator hood 130.

Also shown in FIG. 12 is a lip 146 on the cover 138 to aid in opening the covers 134 and 138. A covering 148, which is preferably a gas-impermeable material, in order to protect the gas treatment unit 128 from humidity/moisture, etc., is adjacent to the cover 138 and attached to cover 134 at its perimeter. A tab 150 is provided for easy peel back of the covering 148. A handle 152 is integral to the over 134, which along with the lip 146 makes for easy gripping of the assembly 126. The handle 152 and the lip 146 are also used for easy opening of the covers 134 and 138.

FIG. 13 shows a top section of the gas treatment unit 128 highlighting the re-insertable pin 132 which is part of the activation mechanism. Since the pin 132 is integral to the cover 134, detaching or removal of the cover 134 detaches the pin 132 from the switch 136. The blower 62 is thus actuated and the gas treatment unit 128 and the respirator hood 130 are then fully operational.

Figure 14A:
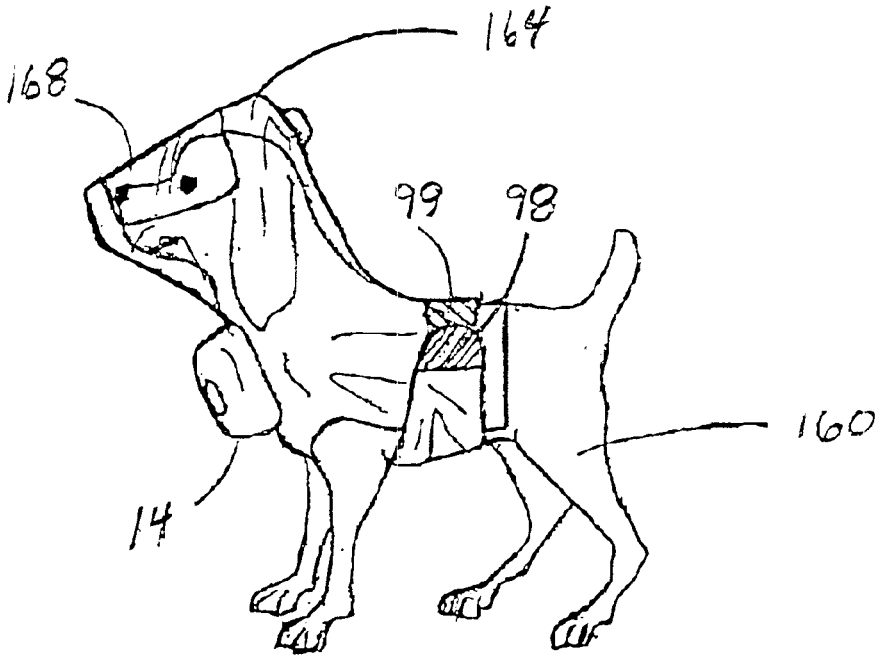
FIGS. 14A and 14B are side views of alternate embodiments of the respirator hood used by dogs illustrating different closure means.
Figure 14B:
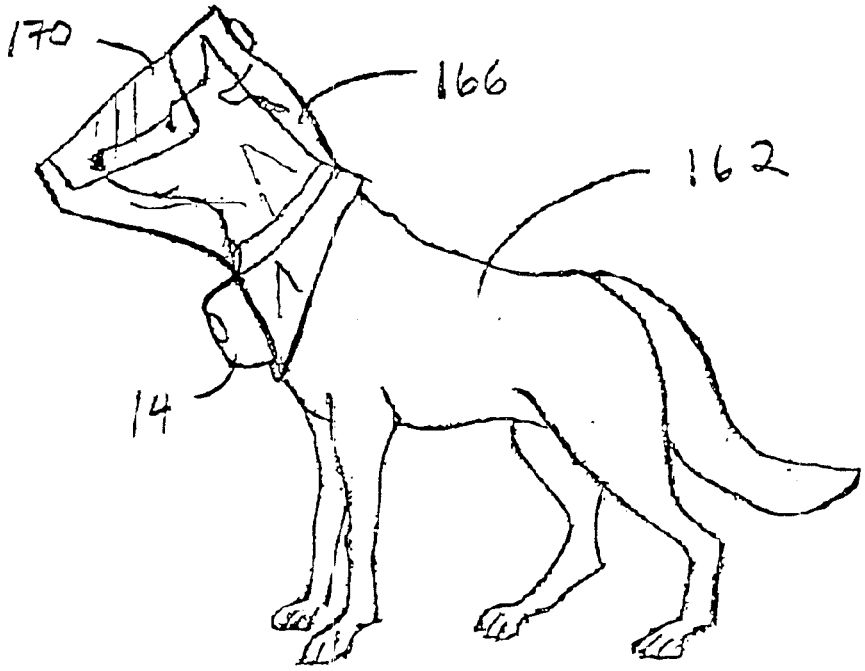

FIGS. 14A and 14B show embodiments that are suitable for animals; depicted by a small dog 160 (FIG. 14A) and a large dog 162 (FIG. 14B). For the small dog 160 a hook and loop closure means, discussed above for infants, may be appropriate. For a large dog 162, a sealing portion such as the elastic neck seal 20 for a human adult user 18 may be appropriate. For animals, hoods 164 and 166, including visors 168 and 170, may require some size and shape differentiation from humans and size and shape differentiation from animal to animal depending on type and size. In the case of very small animals, for example gerbils (not shown), the animal, or more than one animal, can be completely inside the hood 164; 166.

What is claimed is:

1. A positive-pressure respirator hood and container assembly comprising, a gas-impermeable hood made of a flexible material, formed with at least a transparent visor portion;

a gas treatment unit, comprising a filter and a power-operated blower capable to force air through the filter and generate a positive pressure within the hood;

a one-way purge valve for facilitating the exhaust of exhaled gases and moisture from the hood;

a sealing portion for sealingly securing the hood over a body portion of the user; and a container for said hood;

wherein said hood is compactly received within said container; and wherein, prior to removing the hood from the container, opening the container causes said gas treatment unit to be automatically activated by at least one activating member interacting between the hood and the container, thereby deploying the hood into an operating state such that said hood is conveniently available to the user to provide protection from toxic gases and particulate material.

2. An assembly according to claim 1, where said container comprises a front and a rear cover, wherein separation of one cover from another allows opening the container and immediate deploying the respirator hood into the operative state.

3. An assembly according to claim 1, where the body portion is a user's neck and where the sealing portion is a neck-engaging collar made of an elastic material.

4. An assembly according to claim 1, where the sealing portion is designed to easily stretch over the head of the user and sealingly fit around the neck of the user after the hood is donned.

5. An assembly according to claim 1, where the body portion is a user's torso and where the sealing portion is a torso-engaging and sealing wrap.

6. An assembly according to claim 5, wherein the sealing wrap is adapted for elastic engagement over the user's torso.

7. An assembly according to claim 1, where the respirator hood is adapted for wearing by an animal.

8. An assembly according to claim 1, wherein the container comprises at least one detachable member articulated with an activating switch of the gas treatment unit, whereby detaching the member activates the power-operated blower.

9. An assembly according to claim 1, wherein the gas treatment unit forcibly supplies filtered air into the hood giving rise to pressure build-up therein.

10. An assembly according to claim 1, wherein the container comprises a front and a rear cover, at least one of which is articulated to an activating switch provided in the gas treatment unit.

11. An assembly according to claim 10, wherein the front and rear covers are engageable into a closed position, wherein the respiratory hood and gas treatment unit are confined within the container in a gastight manner.

12. An assembly according to claim 10, wherein at least one of the front and rear covers is fitted with a handle, to facilitate its detachment.

13. An assembly according to claim 1, said assembly being deployable in a storage state and an operative state; wherein at said storage state the hood and the gas treatment unit are sealingly received within said container whereupon opening the container immediately and automatically activates the gas treatment unit.

14. An assembly according to claim 13, wherein the container is rigid.

15. An assembly according to claim 13, wherein the gas treatment unit comprises an activating switch coupled via a toggle member to a portion of the container, whereby opening the container automatically activates the switch.

16. An assembly according to claim 15, wherein the toggle member is attached to one of the covers by a latch.

17. A respirator hood according to claim 16, wherein the latch ruptures upon opening the container.

18. An assembly according to claim 1, where the protection from toxic gases, particles, line spray, or aerosols is protection from inhalation.

19. An assembly according to claim 1, where the protection from toxic gases, particles, fine spray, or aerosols is protection from contact.

20. An assembly according to claim 1, in which said gas treatment unit is provided with a mechanically activatable switch.

21. An assembly according to claim 1, where the assembly is easily and conveniently carried in a purse or briefcase and/or stored nearby the user.

22. An assembly according to claim 1, where the assembly fits within a standard office briefcase.

23. An assembly according to claim 1, where the assembly is designed as a one-size-fits-all above age of three.

24. An assembly according to claim 1, where the hood is designed to fit users of a size range from toddlers to large adults.

25. An assembly according to claim 1, where the hood is designed to fit users regardless of head or facial features.

26. An assembly according to claim 1, where the hood is designed to fit users who have long hair or wear eyeglasses.

27. An assembly according to claim 1, wherein the gas treatment unit is fixed to the respirator hood.

28. A positive-pressure respirator hood and container assembly comprising a gas-impermeable hood made of a flexible material, formed with at least a transparent visor portion;

a gas treatment unit, comprising a filter and a power-operated blower capable to force air through the filter and generate a positive pressure within the hood;

a one-way purge valve for facilitating the exhaust of exhaled gases and moisture from the hood;

a sealing portion for sealingly securing the hood over a body portion of the user; and a container for said hood;

wherein said hood is adapted to be compactly received within said container, and to be deployed into an operative state automatically, whereby a user is provided protection from toxic gases and particulate material, wherein the container comprises at least one detachable member articulated with an activating switch of the gas treatment unit, whereby detaching the member activates the power-operated blower, and wherein the at least one detachable member is re-insertable whereby the power-operated blower is de-activated.

* * * * *